US008682187B2

(12) United States Patent
Takuma et al.

(10) Patent No.: US 8,682,187 B2
(45) Date of Patent: Mar. 25, 2014

(54) DEVELOPMENT DEVICE AND IMAGE FORMING APPARATUS INCORPORATING SAME

(75) Inventors: Yasuo Takuma, Kanagawa (JP); Junichi Matsumoto, Kanagawa (JP); Tomoya Ohmura, Kanagawa (JP); Hiroshi Kikuchi, Kanagawa (JP); Natsumi Matsue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 13/137,618

(22) Filed: Aug. 30, 2011

(65) Prior Publication Data

US 2012/0057890 A1 Mar. 8, 2012

(30) Foreign Application Priority Data

Sep. 8, 2010 (JP) ..... 2010-201262
Jun. 27, 2011 (JP) ..... 2011-141658

(51) Int. Cl.
*G03G 15/08* (2006.01)

(52) U.S. Cl.
USPC ..... 399/53; 399/254; 399/258

(58) Field of Classification Search
USPC ..... 399/53, 254, 258
See application file for complete search history.

(56) References Cited

U.S. PATENT DOCUMENTS

| | | | | |
|---|---|---|---|---|
| 7,636,536 | B2 | 12/2009 | Iwata et al. | |
| 7,729,642 | B2 | 6/2010 | Matsumoto et al. | |
| 7,783,233 | B2 | 8/2010 | Iwata et al. | |
| 7,792,472 | B2 | 9/2010 | Ichikawa et al. | |
| 7,835,653 | B2 | 11/2010 | Katoh et al. | |
| 7,912,408 | B2 | 3/2011 | Iwata et al. | |
| 7,953,350 | B2 | 5/2011 | Matsumoto et al. | |
| 8,238,768 | B2 * | 8/2012 | Koizumi et al. | 399/30 |
| 2007/0053721 | A1 | 3/2007 | Matsumoto et al. | |
| 2007/0053723 | A1 | 3/2007 | Iwata et al. | |
| 2007/0154242 | A1 | 7/2007 | Matsumoto et al. | |
| 2007/0166079 | A1 | 7/2007 | Ichikawa et al. | |
| 2007/0264052 | A1 * | 11/2007 | Yoshida et al. | 399/254 |
| 2007/0264053 | A1 | 11/2007 | Iwata et al. | |

(Continued)

FOREIGN PATENT DOCUMENTS

| | | |
|---|---|---|
| JP | 3349286 | 9/2002 |
| JP | 3391926 | 1/2003 |
| JP | 2009036926 A | 2/2009 |
| JP | 2009103750 A | 5/2009 |

OTHER PUBLICATIONS

Abstract of Japanese Patent Publication No. JP08-211714, published on Aug. 20, 1996.

(Continued)

*Primary Examiner* — David Gray
*Assistant Examiner* — Francis Gray
(74) *Attorney, Agent, or Firm* — Harness, Dickey & Pierce, P.L.C.

(57) ABSTRACT

A development device includes a development portion, to develop a latent image formed on a latent image carrier with developer, disposed close to the latent image carrier; a developer agitation container to agitate the developer, provided separately from the development portion; a transport system connecting the development portion and the developer agitation container, through which the developer is transported from the developer agitation container to the development portion by air; and a developer retainer to temporarily retain the developer, disposed downstream from the transport system, to which the developer remaining in the transport system escapes.

14 Claims, 7 Drawing Sheets

(56) References Cited

U.S. PATENT DOCUMENTS

| | | | | |
|---|---|---|---|---|
| 2007/0274740 | A1 | 11/2007 | Katoh et al. | |
| 2008/0226349 | A1 | 9/2008 | Iwata et al. | |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1* | 1/2009 | Matsumoto et al. | 399/258 |
| 2009/0123174 | A1* | 5/2009 | Iwata et al. | 399/92 |
| 2009/0220266 | A1* | 9/2009 | Shiraishi et al. | 399/58 |
| 2009/0317106 | A1 | 12/2009 | Ohmura et al. | |
| 2010/0061774 | A1 | 3/2010 | Iwata et al. | |
| 2010/0124443 | A1 | 5/2010 | Ohmura et al. | |
| 2010/0143000 | A1 | 6/2010 | Matsue et al. | |
| 2010/0290815 | A1 | 11/2010 | Ichikawa et al. | |
| 2011/0044726 | A1 | 2/2011 | Katoh et al. | |
| 2011/0182610 | A1 | 7/2011 | Ohmura et al. | |

OTHER PUBLICATIONS

Abstract of Japanese Patent Publication No. JP08-211723, published on Aug. 20, 1996.

* cited by examiner

DEVELOPMENT DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2010-201262, filed on Sep. 8, 2010, and 2011-141658, filed on Jun. 27, 2011 in the Japan Patent Office, the entire disclosure of which are hereby incorporated herein by reference.

BACKGROUND OF THE INVENTION

1. Field of the Invention

The present invention relates to a development device and an image forming apparatus incorporating the development device, such as a copier, a printer, a facsimile machine, a plotter, or a multifunction machine capable of at least two of these, and more particularly, to a development device including a developer agitation container separated from a development portion and an air circulation mechanism for circulating developer between the developer agitation container and the development portion 2. Description of the Background Art Known development devices included in electrophotographic image forming apparatuses employ a configuration in which supplying developer (toner) to a photoreceptor drum functioning as a latent image carrier, on the one hand, and mixing and agitating the developer and the supplied toner on the other are performed simultaneously in a development device housed in a single casing. The development device includes at least two conveyance screws that transport the developer in opposite directions, thus circulating the developer inside the development device.

At present, there are development devices in which an agitation container to agitate the developer is provided separately from the part of the device that actually develops the image (a "development portion") with the developer that has been sufficiently agitated in the agitation portion being conveyed to the development portion. This system has the advantage that, since the agitation container is separated from the development portion, the capacity of the development portion can be minimized, thus minimizing the proportion of the development portion occupying the area near the photoreceptor drum. In addition, an efficient way to convey the developer from the agitation container is by a pneumatic system to convey the developer by air from the agitation container. As above-described pneumatic system used for the development device, several approaches are proposed.

In a configuration in which the pneumatic method is used as the conveyance mechanism of the developer, matters can be simplified in that a free path at any place connecting the separate path by using a flexible tube and an air pump can be utilized. However, in a state in which the developer is supplied to a casing having an opening in a part, for example, close to a development sleeve in the development portion, the developer and the toner therein is blown outside. Consequently, failure, such as fouling the surrounding components and uncontrolled scattering of toner on the output image may occur. Such scattering of the developer sullies the interior of the image forming apparatus, thereby also degrading image quality.

In particular, this failure occurs most readily when the development device is activated. This is because any developer remaining in the tube functioning as the transport path after a previous developing process is packed together under its own weight, and bulk density of the developer is increased, clogging the tube. The clogging causes a delay until it is dissolved and the bulk density of the developer is decreased so that the developer can be transported through the tube and the conveyance of the developer is started.

During the delay, the developer in the development portion is circulated by the conveyance screws, and then is moved back to the agitation container through a collection path connected to the development portion. Consequently, the amount of the developer in the development portion is decreased, and in the worst case, the developer may be completely gone from the development portion. In this case, the transported air is blown to a space and the opening that has hitherto been blocked by the developer, and the developer and the toner in the development portion becomes easily blown out through the opening. In some cases, the amount of the scattering developer is dozens of times the amount thereof when the opening is blocked by the developer.

In addition, the delay until the clog is dissolved and the bulk density is decreased to a state in which the developer can be transported, by the air varies depending on a concentration of toner in the developer as well as how long the developer has been left sitting and in what state. Consequently, more reliable prevention of the depletion of the developer in the development portion is desired.

SUMMARY OF THE INVENTION

In one exemplary embodiment of the present invention, a development device includes a development portion, a developer agitation container, a transport system, and a developer retainer. The development portion develops a latent image formed on a latent image carrier with developer, disposed close to the latent image carrier. The developer agitation container agitates the developer and is provided separately from the development portion. The transport system connects the development portion and the developer agitation container, through which the developer is transported from the developer agitation container to the development portion by air. The developer retainer temporarily retains the developer, disposed downstream from the transport system, to which the developer remaining in the transport system escapes.

In another exemplary embodiment of the present invention, an image forming apparatus includes a latent image carrier to carry a latent image and the above-described development device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
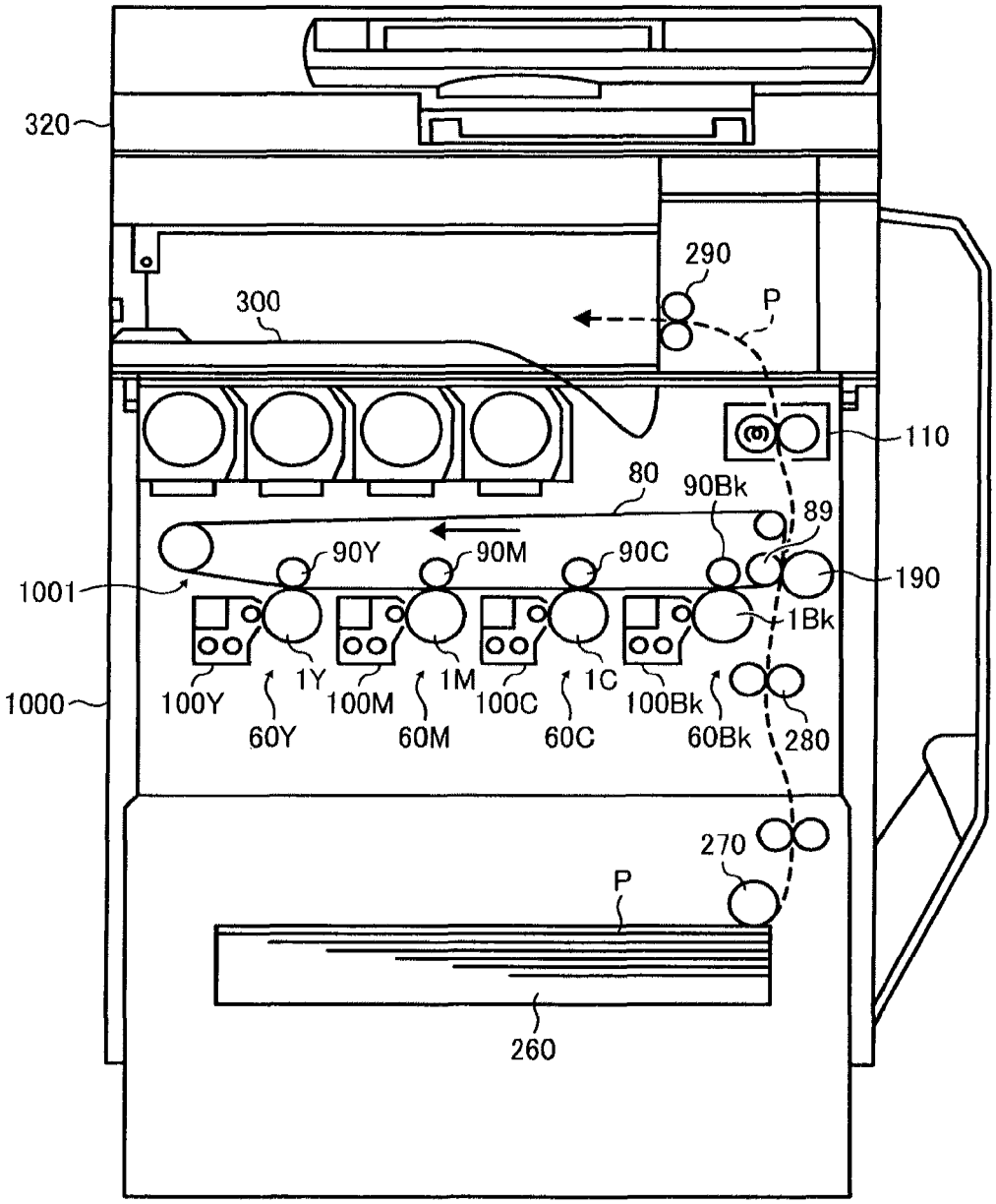
FIG. 1 is a schematic diagram illustrating an image forming apparatus employing a development device according to exemplary embodiments.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

An image forming apparatus 1000 in FIG. 1 includes an intermediate transfer unit 10. Image forming units 60Y, 60M, 60C, and 60Bk for respectively forming yellow, magenta, cyan, and black (hereinafter also simply "Y, M, C, and Bk") single-color toner images are disposed facing a lower surface of an intermediate transfer belt 80 in an intermediate transfer unit 1001. It is to be noted that, in this specification, reference character suffixes Y, M, C, and Bk attached to an identical reference numeral indicate only that components indicated thereby are used for forming different single-color images, respectively, and hereinafter may be omitted when color discrimination is not necessary. As shown in FIG. 1, each of the image forming units 60 includes a drum-shaped photoreceptor 1 functioning as a latent image carrier. A charging device, a development portion 2 of a development device 100, and a cleaning device are disposed around the photoreceptor 1 in each of the image forming units 60.

On the photoreceptor drum 1, image forming process including a charging process, an exposure process, a development process, a primary transfer process, and a cleaning process is executed, and thus a desired toner image is formed on the photoreceptor drum 1. The photoreceptor drum 1 is rotated clockwise by a driving mechanism, not shown, and, in the charging process, the surface of the photoreceptor drum 1 is uniformly charged in a portion facing the charging device. When the surface of the photoreceptor drum 1 reaches a portion receiving a laser beam emitted from an exposure device, not shown, in the exposure process, the laser beam scans the surface of the photoreceptor drum 1, thus forming a latent image on the portion receiving the laser beam. Then, when the portion of the surface of the photoreceptor drum 1 reaches a portion facing the development portion 2 of the development device 100, the latent image thereon is developed into a toner image with the toner included in developer supplied from the development device 100, that is, development process is executed. In the primary transfer process, the surface of the photoreceptor drum 1 that carries the toner image developed in the development process reaches the portion facing the intermediate transfer belt 80 and primary transfer bias rollers 90, where the toner image on the photoreceptor drum 1 is transferred onto the intermediate transfer belt 80 and four toner image are superimposed one on another on the surface of intermediate transfer belt 80.

After the primary transfer process, the surface of the photoreceptor drum 1 reaches a portion facing the cleaning device, where un-transferred toner that remains on the surface of the photoreceptor drum 1 is collected by the cleaning device in the cleaning process. After the cleaning process electrical potential on the surface of the photoreceptor drum 1 is first activated by a discharging roller, not shown. Undergoing these processes, the image forming process performed on the photoreceptor drum 1 is completed.

After the image forming process on the image forming unit 6, a secondary transfer process is executed in the intermediate transfer unit 1001. In the secondary transfer process, a superimposed four-color toner on the intermediate transfer belt 80 is transferred onto a transfer sheet P, serving as a recording medium, at one time.

The above-described image forming process is executed in both monochrome printing in black and white and multicolor printing. When multicolor printing is executed, four image forming units 60Y, 60M, 60C, and 60Bk perform the above-described image forming processes, respectively. Namely, the exposure device (optical writing member), not shown, positioned beneath the image forming units 6 irradiates the respective photoreceptor drums 1 in the image forming units 60 with the respective laser beams in accordance with image data. After that, the toner images formed on the respective photoreceptor drums 1Y, 1M, 1C, and 1Bk in the development process are primarily transferred from the photoreceptor drums 1 and are superimposed one on another on the surface of the intermediate transfer belt 80. Thus, a multicolor (four-color) image is formed on the intermediate transfer belt 80.

More specifically, the intermediate transfer belt 80 is sandwiched between the primary transfer bias rollers 90Y, 90M, 90C, and 90Bk and the photoreceptor drums 1Y, 1M, 1C, and 1Bk, and primary transfer nips are formed therebetween, respectively. Each primary transfer bias roller 90 applies a transfer bias that has a reverse polarity (e.g., positive polarity) to the polarity of the toner to a backside (inner circumference face) of the intermediate transfer belt 80. While the intermediate transfer belt 80 moves in a direction indicated by arrow shown in FIG. 1 and goes through the primary transfer nips sequentially, the respective toner images on the photoreceptor drums 1Y, 1M, 1C, and 1Bk are primarily transferred and are superimposed one on another on the surface of the intermediate transfer belt 80.

The intermediate transfer belt 80 is sandwiched between a secondary transfer roller 190 and a secondary transfer bias roller 89, and a secondary transfer nip is formed therebetween. When the superimposed four-color toner image formed on the surface of the intermediate transfer belt 80 reaches the secondary transfer nip, the four-color toner image is transferred onto the transfer sheet P at one time. Undergoing these processes, the transfer process performed on the intermediate transfer belt 80 is completed.

A feeding device 260 is disposed in a lower portion of the image forming apparatus 1000 and contains multiple transfer sheets P. The transfer sheet P is fed one-by-one by a feed roller 270. The transfer sheet P thus fed is stopped by a pair of registration rollers 280, and then skew of the transfer sheet P is corrected, after which the pair of the registration rollers 280 transports the transfer sheet P toward the secondary transfer nip at an appropriate timing. Thus, the image is transferred onto the transfer sheet P at the secondary transfer nip. At the secondary transfer nip, in a case in which the image on the intermediate transfer belt 80 is the superimposed image, a desired multicolor image is transferred onto the transfer sheet P.

The transfer sheet P onto which multicolor image is transferred at the secondary transfer nip is transported to a fixing device 110 positioned above the secondary transfer roller 190 in FIG. 1, where the four-color toner image thus transferred is fixed on the surface of the transfer sheet P with heat and pressure in a fixing process. After the fixing process, the transfer sheets P are discharged toward a discharge sheet tray 300 located on an upper portion of the image forming apparatus 1000 via a pair of discharging sheet rollers 290 and are stacked on the discharge sheet tray 300. Thus, a series of the image forming process completes. The image forming apparatus 1000 further includes a scanner 320 that scans a document.

Configuration of Development Device

Figure 2:
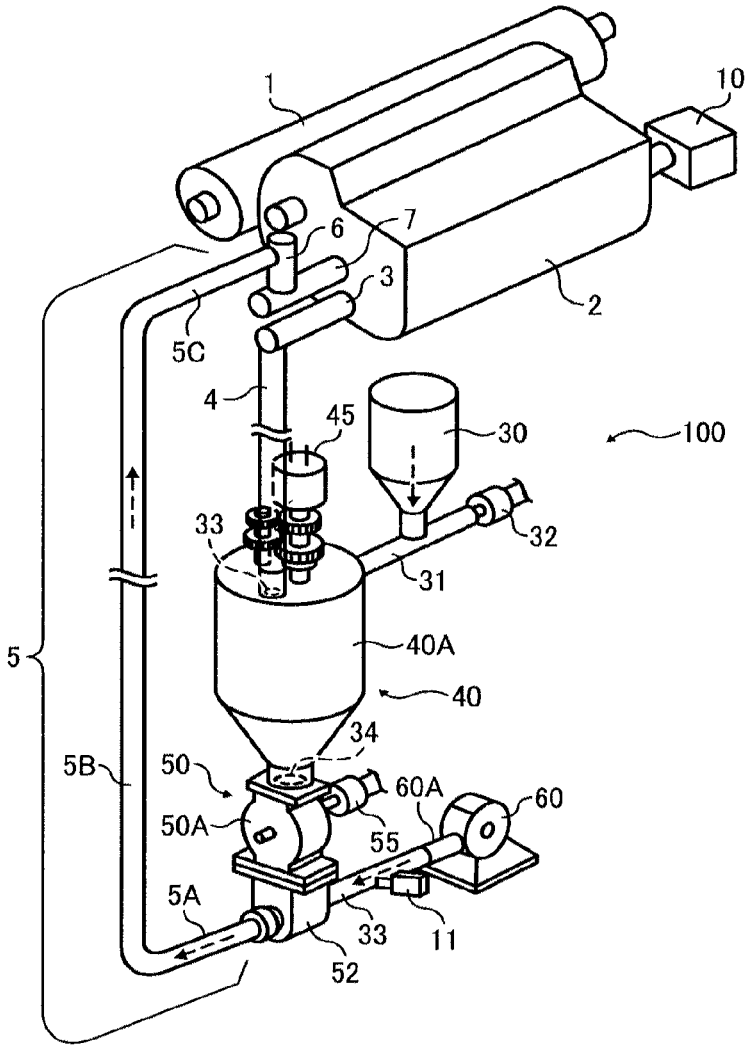
FIG. 2 is a perspective view illustrating an entire configuration of the development device shown in FIG. 1 including a development portion and a developer agitation container.

Next, a configuration of the development device 100 according to the embodiments of this disclosure is described below with reference to FIGS. 2 and 3. FIG. 2 illustrates an entire configuration of the development device 100 according to the present embodiment. In the present embodiment, the development device 100 uses two-component developer including toner and carrier.

The development device 100 shown in FIG. 2 includes the development portion 2 disposed close to the photoconductor drum 1 and a developer agitation container 40 provided separately from the development portion 2. The developer in the developer agitation container 40 is conveyed by air through a developer transport tube 5 and a developer drop tube 6. The developer transport tube 5 functions as a transport system. A developer supply tube 7 is connected to the developer drop tube 6. The developer supply tube 7 and a developer discharge tube 3 are provided on the development portion 2. A developer collection tube 4 is connected between the developer discharge tube 3 and the developer agitation container 40. The developer collection tube 4 and the developer discharging tube 3 function as collection system. The developer from the developer agitation container 40 conveyed by the air through the developer transport tube 5, the developer drop tube 6, and the developer supply tube 7 is developed in the development portion 2. Then, the developer drops under its own weight to the developer collection tube 4 connected to the developer agitation container 40, and then the developer is poured into the developer agitation container 40, which can the developer can circulate the development portion 2 and the developer agitation container 40.

Figure 3:
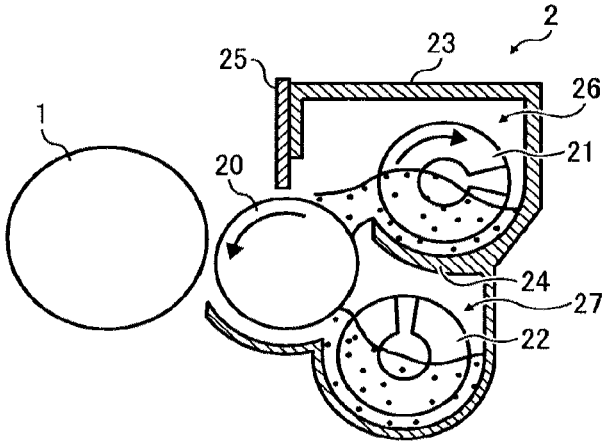
FIG. 3 is a schematic view illustrating an internal configuration of the development portion shown in FIG. 2.

FIG. 3 shows the interior structure of the development portion 2. The development portion 2 executes the development process on the photoreceptor drums 1 by using two-component developer in which carrier particles and toner particles are mixed. As shown in FIG. 3, the development portion 2 includes a development sleeve 20, conveyance screws 21 and 22, and a doctor blade 25. The development sleeve 20 carries the developer and is disposed facing the photoreceptor drum 1. The doctor blade 25 adjusts the amount of the developer carried on the development sleeve 20. The conveyance screws 21 and 22 are offset from the developer sleeve 20 so that they are located respectively higher than and lower than the developer sleeve 20. The development sleeve 20 includes a magnet and carries the developer to cause the toner in the developer to magnetically adhere to the electrostatic latent image formed on the photoconductor drum 1.

The first conveyance screw 21 moves the developer supplied from front side (developer supply tube 7 side) toward the backside of the paper sheet on which FIG. 3 is drawn and the second conveyance screw 22 conveys the developer from the backside toward the front side of the paper sheet on which FIG. 3 is drawn (developer discharge tube 3 side). The development portion is surrounded by a casing 23. The interior of the casing 23 is divided into two chambers by a partition 24, and the first conveyance screw 21 is provided in a first chamber 26, and the second conveyance screw 22 is provided in a second chamber 27.

The development sleeve 20 and the conveyance screws 21 and 22 are rotated by a development-portion driving motor 10 (see FIG. 2) via a drive transmission mechanism. In FIG. 3, the partition 24 is opened in the backside end so that the developer can be moved from the first chamber 26 including the first conveyance screw 21 to the second chamber 27 including the second conveyance screw 22.

The developer supply tube 7 is provided in a front face of the first chamber 26, and the developer discharge tube 3 is provided in a front face of the second chamber 27. The doctor blade 25 to smooth the amount of the developer magnetically attracted by the development sleeve 20 to a uniform thickness is supported by the casing 23, which is disposed to a vicinity of the development sleeve 20.

The casing 23 is covered the vicinity of the conveyance screws 21 and 22. However, the casing 23 is opened at a portion facing the photoreceptor drum 1 so as to supply the developer from the development sleeve 20 to the photoreceptor drum 1, and a gap is present between the casing 23 and the development sleeve 20 to pass the magnet brush of the developer standing on the development sleeve 20 through the gap.

Figure 4A:
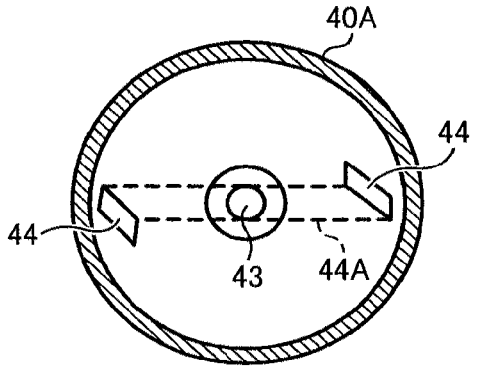
FIG. 4A is a cross-sectional view illustrating agitators provided in the developer agitation container shown in FIG. 2 when view from above.
Figure 4B:
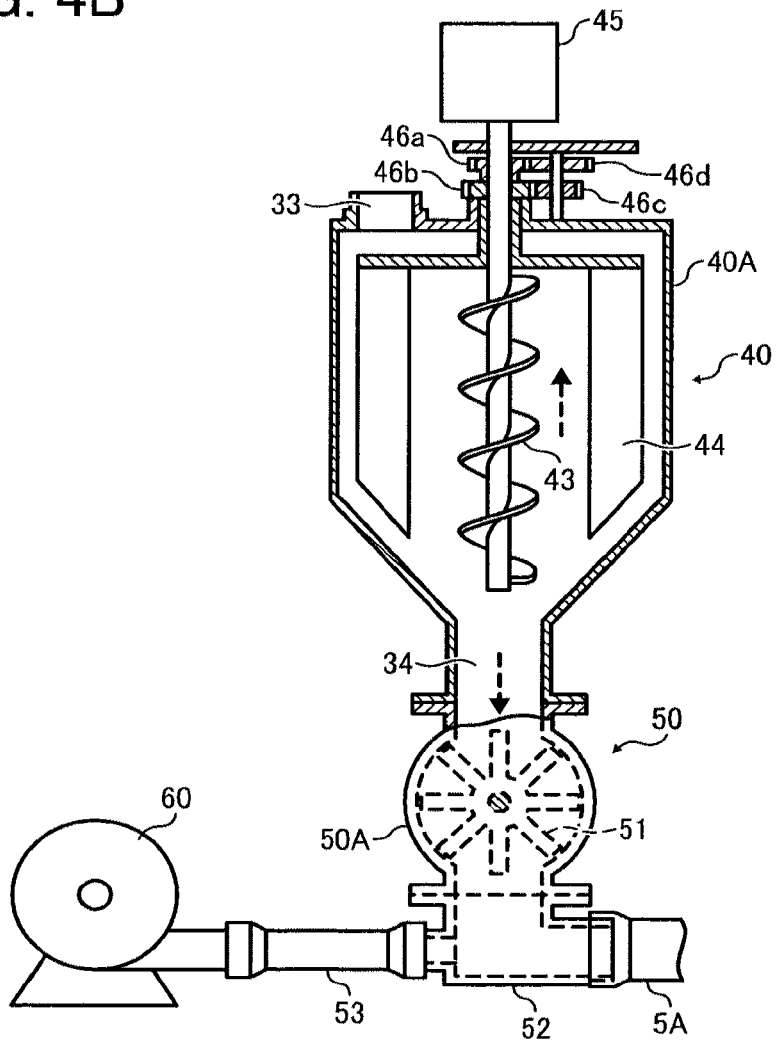
FIG. 4B is a schematic view illustrating an internal configuration of the developer agitation container, a rotary feeder, an air pump in the development device shown in FIG. 2.

FIG. 4A is a cross-sectional diagram illustrating the developer container 40 when viewer from above. FIG. 4B illustrates an internal structure of the developer container 40, a rotary feeder 50, and an air pump 60. As shown in FIGS. 2 and 4B, the developer container 40 has a container casing 40A that is shaped like an upright cylinder, a lower end of which forms a funnel, that is, a tapered portion of downwardly decreasing diameter. A supply opening 33 connected to the developer collection tube 4 is provided on a top of the developer casing 40A. A discharge opening 34 whose diameter is smallest in the developer container 40, provided at a bottom of the container casing 40A, is continuous with the rotary feeder 50.

Meanwhile, a screw agitator 43 that conveys the developer from bottom up, and two blade agitators 44 located outside of the screw agitator 43 are provided inside the container casing 40A of the developer agitation container 40. The screw agitator 43 extends vertically in a center portion of the container casing 40A, and the blade agitator 44 is integrally formed with an upper end blade 44A. The developer in the container casing 40A is mixed by rotating the agitators 43 and 44, as shown in FIG. 4A.

The screw agitator 43 and the blade agitators 44 are rotated by an agitator driving motor 45. More particularly, the screw agitator 43 is directly connected to the agitator driving motor 45, and the blade agitators 44 is rotated while being decelerated by being decelerated gears 46*a*, 46*b*, 46*c*, and 46*d*.

The developer in the development agitation container 40 is conveyed from the supply opening 33 to the discharge opening 34 by gravity. The developer agitation container 40 always contains the developer as a buffer, thus preventing the un-mixed developer from directly discharging outside. The developer lifted from bottom to top by the rotating the screw agitator 43 is moved downward with rotation of the blade agitators 44 that rotates outside of the screw agitator 43 and then is concentrated in the center portion that is the vicinity of the screw agitator 43. Thus, the developer is constantly moved by convection in the container casing 40A. Due to this convection, the developer is mixed uniformly in the entire container casing 40A.

In addition, since the developer of the present disclosure is the two-component developer including toner particles and carrier particles and the toner is charged by friction between the toner and the carrier, it is important for increasing the charging amount to increase contact probability between the toner and the carrier. More particularly, it has experimentally proven that the contact probability is increased by converting the developer, which alleviates the damage to the developer.

Referring back to FIG. 2, the container casing 40A of the developer agitation container 40 is replenished with fresh toner from a toner hopper 30 as appropriate as the toner is consumed. A toner concentration sensor is provided in (or near) the development device 100. In this toner replenish operation, an output value obtained by the toner concentration sensor and a control value of the toner concentration of the developer contained in the development device 100 that is set to a predetermined value are compared. When the output value of the toner concentration sensor is lower than the control value, the developer agitation container 40 is replenished with the fresh toner.

In toner replenishment of the developer agitation container 40, when a driving motor 32 is rotated, and the fresh toner contained in the toner hopper 30 is transported by rotating a small screw conveyer provided inside a toner supply tube 31 that is connected to the container casing 40A of the developer agitation container 40. The small screw conveyer in the toner supply tube 31 is configured to transport the fresh toner in the toner hopper 30 at a constant amount.

Beneath the developer container agitation container 40, the rotary feeder 50, functioning as a developer feeder to supply the developer from the developer agitation container 40 to the developer transport tube 5, is provided. The rotary feeder 50 is continuous with the developer agitation container 40, and the developer agitated in the developer agitation container 40 is supplied to the rotary feeder 50. The developer feeder 50 can discharge the constant amount of the developer from the developer agitation container 40 while adjusting the amount of the developer. More specifically, a rotatable impeller 51 is provided inside a casing 50A of the rotary feeder 50 (see FIG. 4). The constant amount of the developer is discharged to the developer transport tube 5 by rotating the impeller 51 driven by a rotary-feeder driving motor 55 (see FIG. 2), A junction portion 52 is provided beneath the impeller 51. The junction portion 52 is connected to an air pipe 53 and an entrance tube 5A of the developer transport tube 5. An air supply tube 60A connects the air pump 60 and the junction portion 52. The air pump 60 functions as a pneumatic device to generate air to move the developer from the rotary feeder 50 to the developer transport tube 5. The constant amount of the developer discharged by the impeller 51 is transported to the developer dropping tube 6 through the developer transport tube 5 by blowing air supplied from the air pump 60. Then, the developer in the developer dropping tube 6 is transported to the development portion 2 through the developer supply tube 7. With this configuration, the developer is circulated between the developer agitation container 40 and the development portion 2.

Herein, a configuration of the development device 100 that includes the above-described pneumatic mechanism (air circulation mechanism) is described below, beginning with the reason for its inclusion.

In the configuration of the development portion 2, the slight gap is present between the casing 23 and the development sleeve 20. The gap is set for passing a magnetic brush standing on the development sleeve 20 that is adjusted by the doctor blade 25 through the gap between the casing 23 and the development sleeve 20. Accordingly, when the air-flow used for the conveyance of the developer enters the development portion 2, the air is blown out of the gap and the developer may leak from the casing 23. In order to prevent the air from blowing outside and the developer from leaking outside, in the development device 100 according to the present embodiment, the developer in the development portion 2 functions as a barrier.

More specifically, the developer used for the development in the development portion 2 is transported to the developer agitation container 40 through the developer discharge tube 3 and the developer collection tube 4, and the developer is sufficiently agitated with fresh toner and is properly electrically charged in the developer agitation container 40. Then, the developer is returned to the development portion 2 through the developer transport tube 5, and thus the development portion 2 executes stable development operation. The operation of the respective components in the development device 100 is controlled such that an outflow path through which the developer and the air leak out is always blocked by the developer functioning as the barrier whenever the air used for the conveyance of the developer enters the casing 23.

Figure 5A:
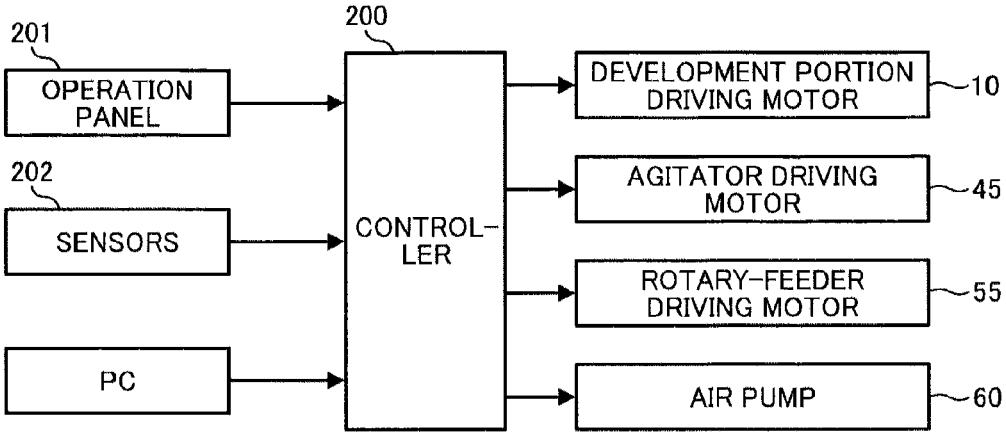
FIG. 5A is a block diagram illustrating configuration of a control mechanism to control operation in the development device show in FIG. 2.

FIG. 5A is a block diagram illustrating a configuration of a control mechanism to control the above-described operation. In the control mechanism of FIG. 5A, a control panel 201, sensors 202, and a computer (e.g., a PC as shown in FIG. 5A) are connected to an input side of a controller 200. The development-portion driving motor 10 that drives screw conveyers 21 and 22 in the development portion 2, the agitator driving motor 45 provided in the developer agitation container 40, the rotary-feeder driving motor 55, and the air pump 60 are connected to an output side of the controller 200. The control panel 201 includes an activation switch to send commands to activate and stop operation of components (2, 40, 50, and 52) included in the development device 100 and components in the main unit image forming apparatus 1000. The operation sensors 202 include the developer concentration detection sensor and check the operation of the components in the development device 100 and devices involved in the image forming processing. The computer (PC) outputs an image forming processing command to the image forming apparatus 1000 externally.

Figure 5B:
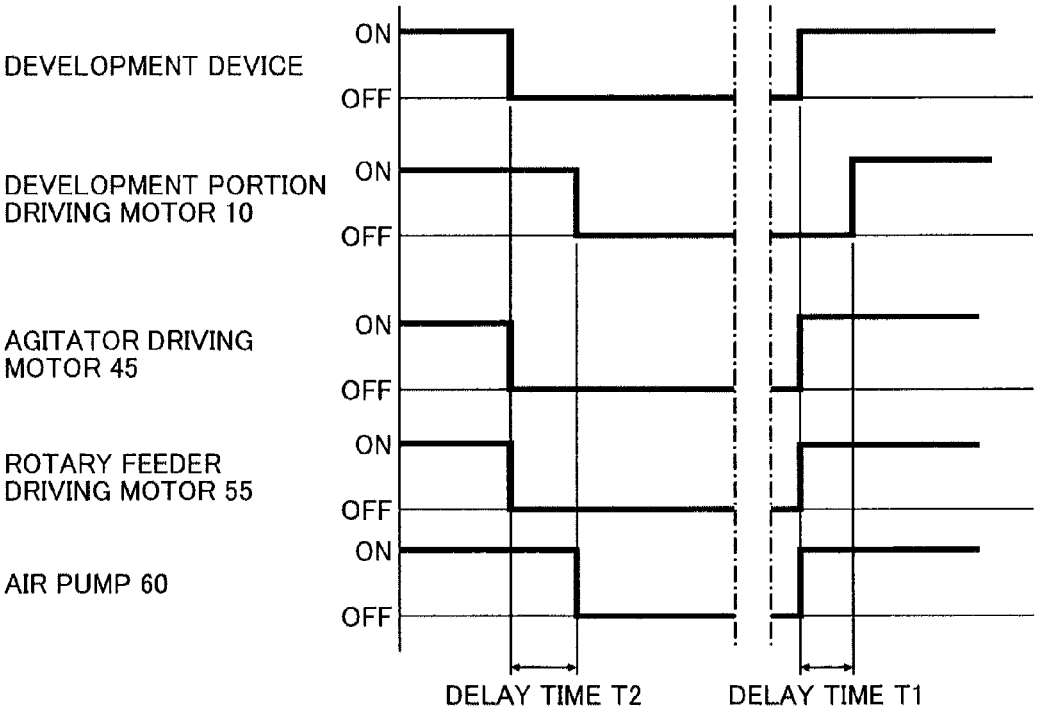
FIG. 5B is a timing chart illustrating operation in the development device controlled by the control mechanism shown in FIG. 5A.
Figure 6:
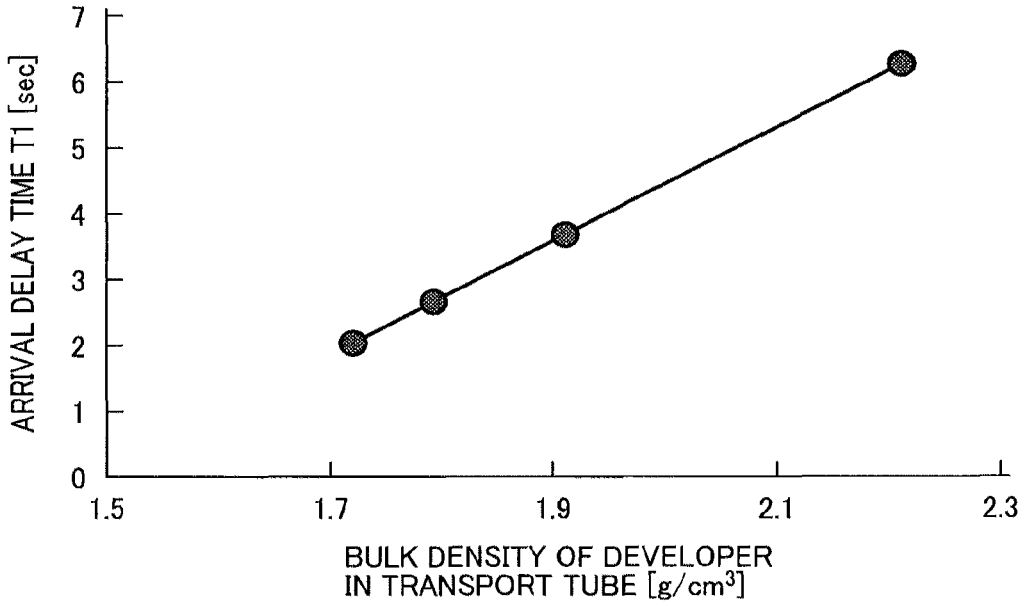
FIG. 6 shows a relation between an arrival delay time and a bulk density while the arrival delay time was is changed to predetermined assumed bulk densities of the remaining developer.

The controller 200 controls operation period including a stop time and an activation time in the respective components, such that the developer can be stopped based on predetermined conditions so as to prevent the air from leaking out of conveyance paths (developer transport tube 5, developer dropping tube 6, developer supply tube 7, developer discharge tube 3, developer collection tube 4) including the development portion 2 when the air is blow therein. FIG. 5B is a timing chart illustrating operation in the development device 100 controlled by the control mechanism shown in FIG. 5A. The reason for the above-described control is as follows:

Herein, the developer residue is described. An arrival delay time T1 from when the air pump 60 is activated in a case in which the developer remains in the developer transport tube 5 to when the developer reaches the developer supply tube 7 was measured. Thus, FIG. 6 shows a relation between the arrival delay time T1 and the bulk density as the arrival delay time T1 is changed to predetermined assumed bulk densities of remaining developer. In this measurement, the weight of remaining developer was constant. As is clear in FIG. 6, as the bulk density of the remaining developer is increased, the arrival delay time T1 from the start of conveying the developer to the arrival of the developer to the developer supply tube 7 is increased. The bulk density is changed within a range from a maximum to a minimum use toner concentration. In this example, the bulk density of the developer is set from 1.7 $g/cm^3$ (at maximum toner concentration) to 2.0 $g/cm^3$ (at minimum toner concentration). In addition, the bulk density is changed depending on a weight of the developer and a state of the packed developer compressed under its own weight and by applying vibration. In FIG. 6, 2.2 $g/cm^3$ is a value when the developer is packed by pressing by applying vibration. As is clear in FIG. 6, the arrival delay time T1 varied from approximately 1 second to 8 second in a range of the assumed changed bulk density.

In the present embodiment, since a time of circulating developer in the development portion 2 is around 2 second, in a case in which a delay occurs over 2 second, the developer in the development portion 2 is depleted. At this time, since the barrier formed by the developer that prevents the air from leaking outside is not present, the air for conveyance is blown outside from the development portion 2, which causes the toner to scatter. The amount of the scattering toner in a state in which the developer is deleted in the development portion 2 is ten times of amount in a state in which the developer is not depleted.

In anticipation of these problems, activation time and stop time to activate and stop operation of the respective components in the development device 100 are set to ensure an amount of the developer remaining in the development portion 2 of the development device 100 in a first embodiment, which is described detail below.

FIRST EMBODIMENT

During operation of the development device 100, in a state in which the development device 100 receives a command to stop the development device 100 from the control panel 201 in the image forming apparatus 1000 or a computer (PC) connected externally via the controller 200, initially, the controller 200 stops the rotary-feeder driving motor 55 that drives the rotary feeder 50. Then, the controller 200 stops the air pump 60 and the development-portion driving motor 10 that drives the development portion 2 after a predetermined delay time T2 (to be determined as described below) has elapsed as shown in FIG. 5B.

Namely, when the command to stop operation of the development device 100 is transmitted from the control panel 201, the controller 200 stops the air pump 60, after the controller 201 stops the rotary feeder 50 and the developer in the developer transport tube 5 escapes to the developer supply tube 7 as a developer retainer.

In the timing chart of FIG. 5B, although the agitator driving motor 45 that drives the agitators 43 and 44 in the agitation container 40 is stopped at the same time to the time when the rotary-feeder driving motor 55 in the present embodiment, the agitator driving motor 45 can be stopped at any time from when the development device 100 receives the command to stop the operation in the development device 100 to when the development device 100 is completely stopped.

The movement of the developer under the control operation is described below. During operation of the development device 100, as described above, the developer is supplied from the rotary feeder 50 to the developer transport tube 5. Immediately after the rotary-feeder driving motor 55 that drives the rotary feeder 50 is stopped, the supply of the developer from the rotary feeder 50 to the developer transport tube 5 is stopped.

At this time, since the operation of the air pump 60 is not stopped, the developer passing through the developer transport tube 5 is transported from an upstream end to a downstream end therein, and finally the developer is transported to the developer dropping tube 6. Herein, the developer transport tube 5 includes the entrance tube 5A, a vertical tube 5B, and a horizontal tube 5C. In the circulation route of the development transport tube 5, the developer from the entrance tube 5A is transported upward through the vertical tube 5B that is parallel to a gravity direction and then is transported sideward through the horizontal tube 5C that is connected to the vertical tube 5B, extending in a horizontal direction. The horizontal tube 5C is connected to the developer dropping tube 6 provided above the developer supply tube 7. Accordingly, once the developer is transported to the developer supply dropping tube 6, the developer drops into the developer supply tube 7 by gravity through the developer dropping tube 6. Thus, the developer in the developer transport tube 5 is guided to the develop supply tube 7 functioning as the developer retainer (escape portion) that temporally retains the developer.

In addition, since the horizontal tube 5C extending in the substantially horizontal direction is located in an extremely downstream end in the developer transport tube 5, the developer transported downstream from the horizontal tube 5C is prevented from moving reversely to the vertical tube 5B by falling freely by gravity. Namely, the horizontal tube 5C is disposed downstream from the vertical tube 5B so that the developer is prevented from flowing in reverse from developer supply tube 7 (developer retainer) to the vertical tube 5B. Accordingly, the horizontal tube 5C that is the downstream end of the developer transport tube 5 and more downstream portion (the developer dropping tube 6, the developer supply tube 7) can be also used as the developer retainer (escape portion) of the developer. In order to prevent the backflow of the developer, it is preferable that an angle between the vertical tube 5B and the horizontal tube 5C is set smaller than a repose angle of the developer.

Further, in the present embodiment, a stop time of the development-portion driving motor 10 that drives the development portion 2 is set identical to a stop time of the air pump 60 so that the developer does not overflow in the developer supply tube 7. Accordingly, the developer escaped in the developer supply tube 7 is transported to the more downstream from the first transport screw 21 in the first chamber 26, the developer positioned close to the first transport screw 21 is transported to the second chamber 27, and the developer close to the second transport screw 22 is transported to the agitation container 40 through the developer discharge tube 3 and the developer collection tube 4 consequently.

Therefore, the casing 40A of the developer container 40 is dimensioned so that the casing 40A can hold as much as or greater than a volume of the developer escaped from the developer transport tube 5. It is to be noted that, a portion in which a capacity needed to hold the escaped developer is ensured (hereinafter just "escaped-developer containing portion") can be disposed any position from the downstream portion (horizontal tube 5C) of the developer transport tube 5 to the stopping rotary feeder 50. For example, the capacity of the developer dropping tube 6 can be set larger so as to hold the escaped developer. In this case, the time of the stop operation of the development-portion driving motor 10 can be set identical to the stop time of the rotary feeder 50.

The amount of the developer escaped from the developer transport tube 5, that is, "a weight of remaining developer m3 (g)" in the developer transport tube 5 is obtained by multiplying "a flowing amount M3 (g/s)" of the developer passing in the developer transport tube 5 and "a transit time T4" during which the developer passes through the developer transport tube 5 (sec) (m3=M2×T4). In the present embodiment, the flowing amount M3 that can be used is set around 125 (g/s), and the developer transport tube 5 contains 250 g of the developer that is obtained by multiplying 125 (g) of the flowing amount M3 and 2 second of the transit time T4 during which the developer passes through the developer transport tube 5 (250 (g)=125 (g/s)×2 (sec)). Based on this weight, it is necessary that the escaped-developer containing portion can hold as much as 200 (g) of the developer obtained by subtracting 250 (g) of the containing developer by 50 (g) of the weight of remaining developer m3 in the entrance tube 5A.

A volume of the escaped-developer containing portion is a same value obtained by dividing the weight of remaining developer m3 by bulk density of the developer ρ (g/cc) (at maximum amount estimated from the toner concentration of the useable amount) (V(cc)=ρ (g/cc)/m3 (g)). In this embodiment, as is clear in result in FIG. 6, the maximum toner concentration of the developer is around 2 (g/cc). 2.3 (g/cc) of the bulk density in FIG. 6 is a value when the developer is compressed by vibration. Consequently, the development device 100 is configured so that the escaped-developer containing portion is capable of holding 400 (cc) of the developer.

In the first embodiment, the developer escaped in the developer supply portion 7 is transported downstream to the first chamber 26 in the development portion 2 by the first transport screw 21, and the developer positioned close to the first transport screw 21 is transported to the second chamber 27. The developer positioned close to the second transport screw 22 is transported to the developer agitation container 40 through the developer discharge tube 3 and the developer collection tube 4 consequently. With this configuration, the portion in which the capacity needed to hold the escaped excessive developer is ensured (escaped-developer containing portion) is ensured by the container casing 40A of the developer agitation container 40.

In the configuration of the developer circulation mechanism shown in FIG. 2, the developer collection tube 4 connected to the casing 40A is for transporting the developer by dropping by gravity. Accordingly, the escaped-developer containing portion is also ensured by the developer collection tube 4 in addition to that of the container casing 40A.

Figure 7:
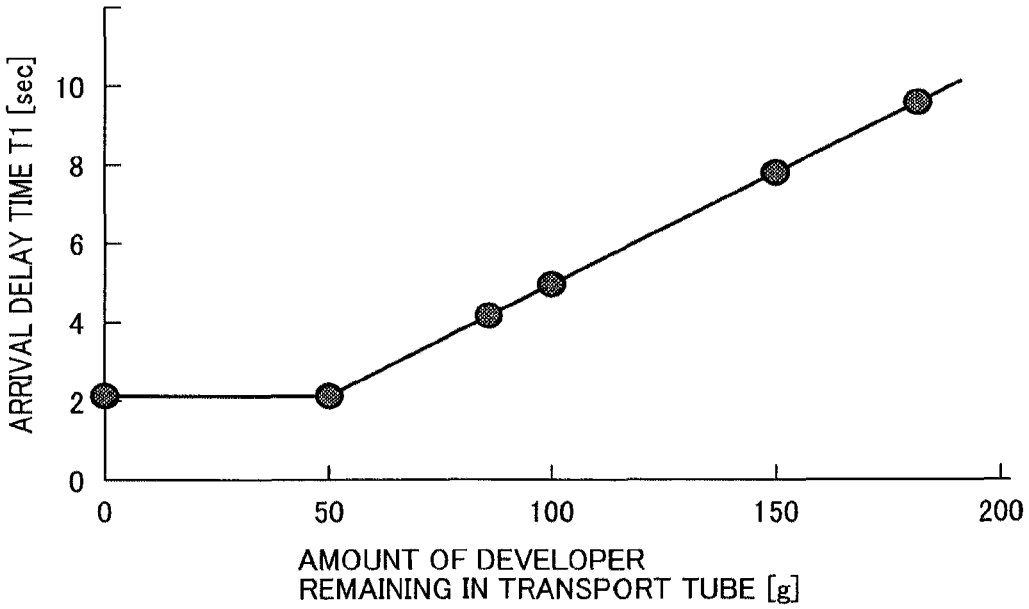
FIG. 7 shows a relation between the arrival delay time and an amount of the developer remaining in a developer transport tube.

Herein, the stop delay time T2 was obtained as follows: FIG. 7 shows relation between the amount of the developer remaining in the developer transport tube 5 and the arrival delay time T1 from the start of transporting developer to the arrival of the developer to the developer supply tube 7. In FIG. 7, when the amount of the developer remaining in the developer transport tube 5 becomes smaller than 50 g, the arrival delay time T1 is around 2 second. This 2 second corresponds to the transit time during which the developer passes through the developer transport tube 5 in the present development device 100.

Figure 9:
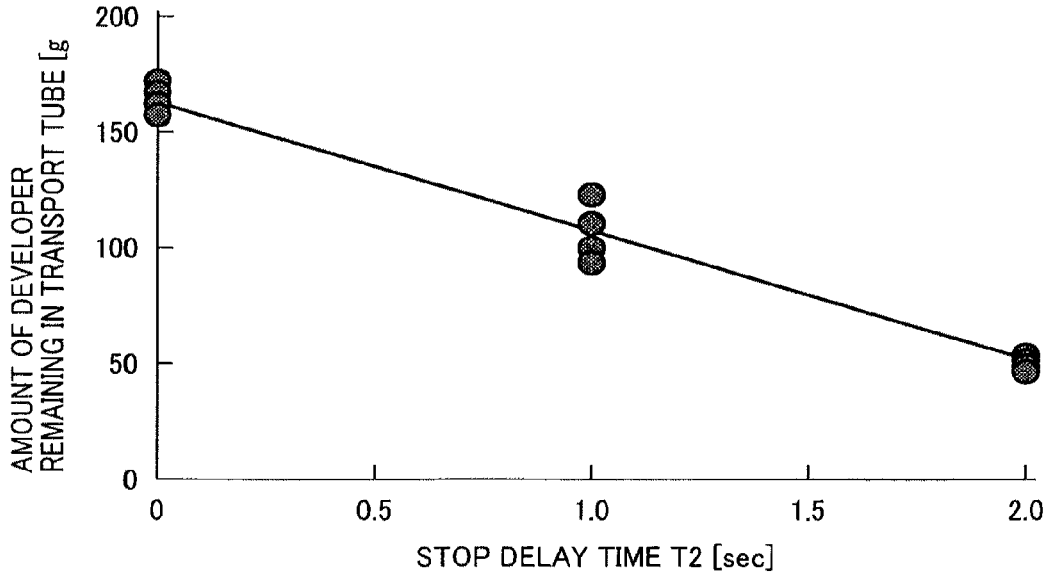
FIG. 9 shows a relation between a stop delay time and the amount of the developer remaining in the developer transport tube before and after the developer is packed.
Figure 10:
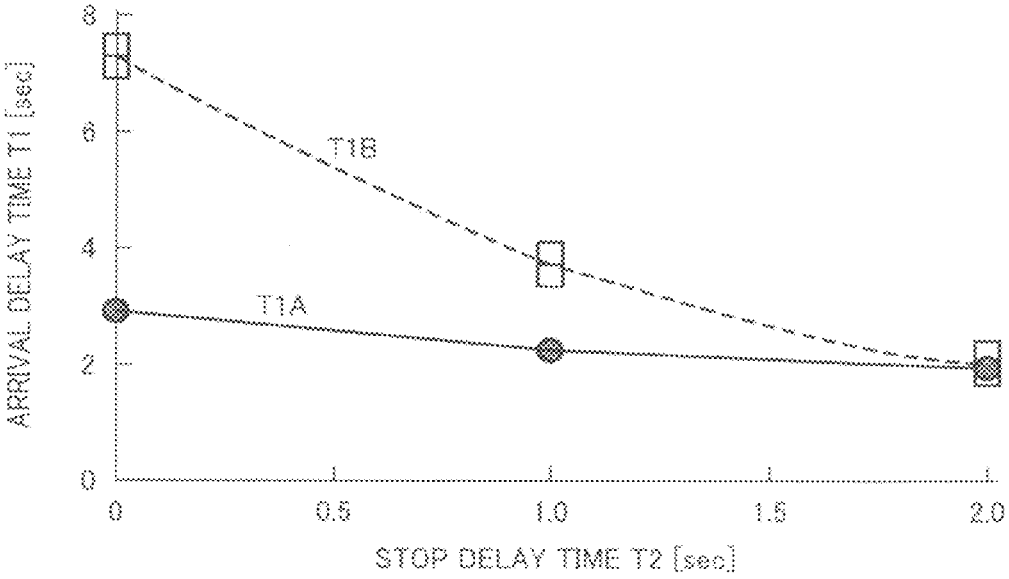
FIG. 10 shows a relation between the stop delay time and the arrival delay time before and after the developer is packed.

FIG. 9 shows a relation between the stop delay time T2 and the amount of the developer remaining in the developer transport tube 5. FIG. 10 shows a relation between the stop delay time T2 and the arrival delay time T1 from the start of transporting developer to the arrival of the developer to the developer supply tube 7. In FIG. 10, relating to an arrival delay time T1A, the agitator driving motor 45 and the rotary-feeder driving motor 55 are stopped, and then the air pump 60 and the development-portion driving motor 10 are stopped after the stop delay time T2 has elapsed. Immediately after that, the agitator driving motor 45, the rotary-feeder driving motor 55, the air pump 60, and the development-portion driving motor 10 are activated at the same time. Thus, the arrival delay time T1A was measured before the developer is packed under its own weight. An arrival delay time T1B was measured in a state in which the developer is packed by applying vibration, similarly to FIG. 6. The above-described stop times for respective devices are represented in the timing chart of FIG. 5B.

Considering results of FIGS. 9 and 10, by setting the stop delay time T2 to around 2 second, the amount of the developer remaining in the developer transport tube 5 become smaller than around 50 g, the arrival delay time T1 of the developer conveyance is to around 2 second before and after the developer is packed. It is to be noted that, similarly to the arrival delay time T1, 2 second of the stop delay time T2 corresponds to the transit time during which the developer passes through the developer transport tube 5 from the upstream end to the downstream end in the present embodiment. The stop delay time T2 may be set greater than at least the transit time during which the developer passes through the developer transport tube 5, 2 second is adapted in the development device 100 in the present embodiment.

Figure 8:
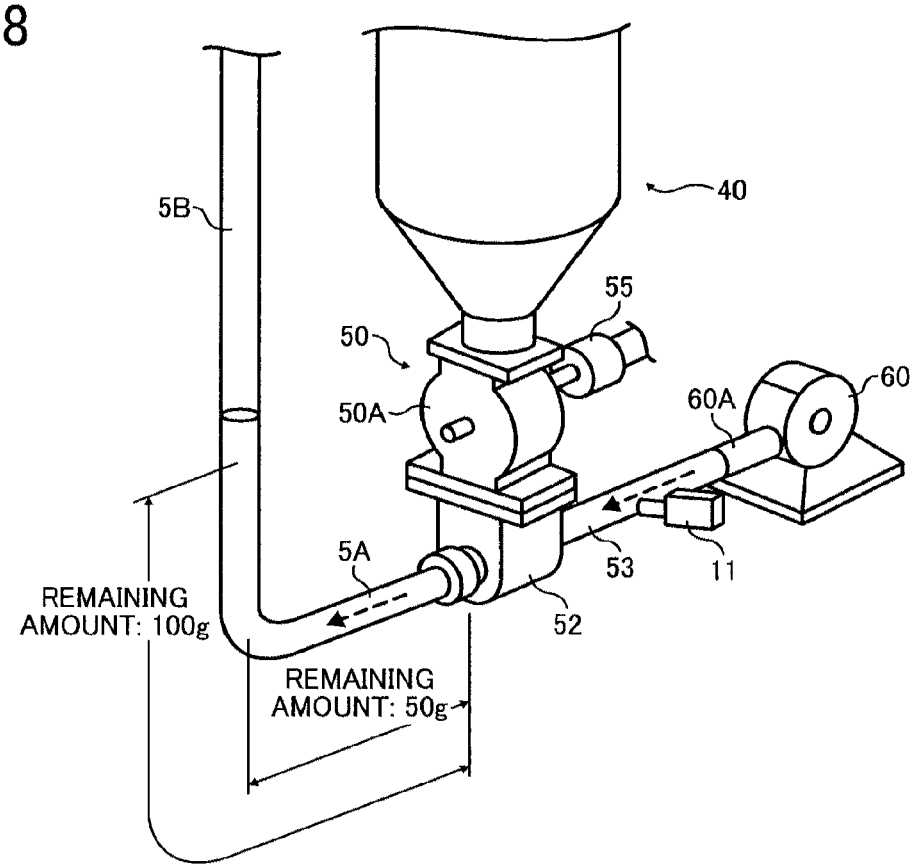
FIG. 8 shows an enlarged pneumatic mechanism in the development device shown in FIG. 2.

FIG. 8 shows an enlarged diagram of the pneumatic mechanism in the development device 100 to represent levels of the remaining redeveloper in the developer transport tube 5 when predetermined amount of the developer remains therein. In addition, when 50 g of the amount of the remaining developer was measured, as shown in FIG. 8, the value of 50 g corresponds the amount of the developer remaining in the entrance tube 5A through which the developer is transported in the horizontal direction. When the developer remains in the horizontal tubes (5A, 5C, 7) and is packed under its own weight, the developer moves to the bottom, that is, the volume of the developer moves to a side to which gravity is subjected. Accordingly, the developer does not block the developer transport tube 5. This phenomena is proven that the arrival delay times before the developer is packed (T1A) and after the developer is packed (T1B) are similar value in the graph shown in FIG. 9. As mentioned above, when the developer remains over 50 g, the amount of the developer exceeds over the entrance tube 5A and the developer further remains in the vertical tube 5B that is parallel to the gravity direction. Thus, as for removing the amount of remaining developer, the development device 100 has only to remove the developer in at least the vertical tube 5B extending in parallel to the gravity direction.

As described above, in the present embodiment, by performing above-described control operation, the developer remaining in the developer transport tube 5, more particularly, the developer remaining in the vertical direction, escapes to the developer retainer disposed from the downstream end (horizontal tube 5B) of the develop transport tube 5, thus preventing clogging of the developer in the developer transport tube 5B. Accordingly, while the development device 100 is operated, the arrival delay time T1 from when the operation of the air pump 60 is started to when the developer reaches the developer supply tube 7 becomes stable. Considering the time arrival delay T1, when the controller 200 commands to the development device 100 to activate, initially, the agitator driving motor 45 that drives the developer agitation container 40, the rotary-feeder drive motor 55 that drives the rotary feeder 50, and the air pump 60 are activated. Then, after the predetermined delay time T1 (2 second corresponding to the transit time during which the developer passes though the developer transport tube 5 from the upstream end to the downstream end in the present embodiment) has elapsed from the command, the development-portion driving motor 10 is activated to drive the development portion 2. The activation timing is illustrated in FIG. 5B.

Namely, when the command to start operation of the development device is 100 transmitted from the control panel 201, the controller 200 activates the air pump 60 (pneumatic device), after the controller 200 activates the rotary feeder 50 (developer feeder) and the developer in the developer transport tube 5 escapes to the developer supply tube 7 (developer retainer).

In addition, when a case in which the increase of the bulk density of the developer does not occur, for example, a case in which the developer is activated again immediately after the development device 100 is stopped, is recognized based on job data stored in the image forming apparatus 1000 in advance, the escape operation is need not to be performed. Namely, the developer in the developer transport tube 5 escapes to the developer supply tube 7 (developer retainer) in a time interval during which no printing operation is being performed by the image forming apparatus 1000, as determined by job data stored in the image forming apparatus 1000. Consequently, the waste extension of the operation time during stop operation can be prevented.

In the first embodiment, although the developer in the developer transport tube 5 escapes in the stop operation of the development device 100, the timing of the escape operation can be changed variably, which is described as a second embodiment.

SECOND EMBODIMENT

A feature of the second embodiment is that control operation is executed when the development device 100 is first activated, in a case in which the development device is started reactivating by supplying power while the image forming apparatus 1000 is stopped, or in a case in which the development device 100 is not properly stopped.

In the present embodiment, the controller 200 in the image forming apparatus 1000 stores data (finish state data) to determine whether or not the development device 100 is stopped at normal finish when the control panel 201 in the image forming apparatus 1000 outputs the command to first activate the development device 100 via the controller 200.

When the controller 200 determines that the stop state of the development device 100 is not normally finished based on the finish state data, the controller 200 controls the development device 100 such that the air pump 60 is activated and the developer remaining in the developer transport tube 5 escapes to the developer retainer (developer supply tube 7), similarly to the first embodiment. It is to be noted that, in this case, since the developer in the developer transport tube 5 is packed under its own weight over time, the above-described activation delay time T1 may vary depending on what state the developer is packed.

Accordingly, in the present embodiment, a timing at which the bulk density of the developer remaining in the developer transport tube 5 is decreased and the conveyance of the developer is started is determined by an output value of the air pressure sensor 11 provided in the air tube 33 connected to the air supply tube 60A of the air pump 60.

Figure 11:
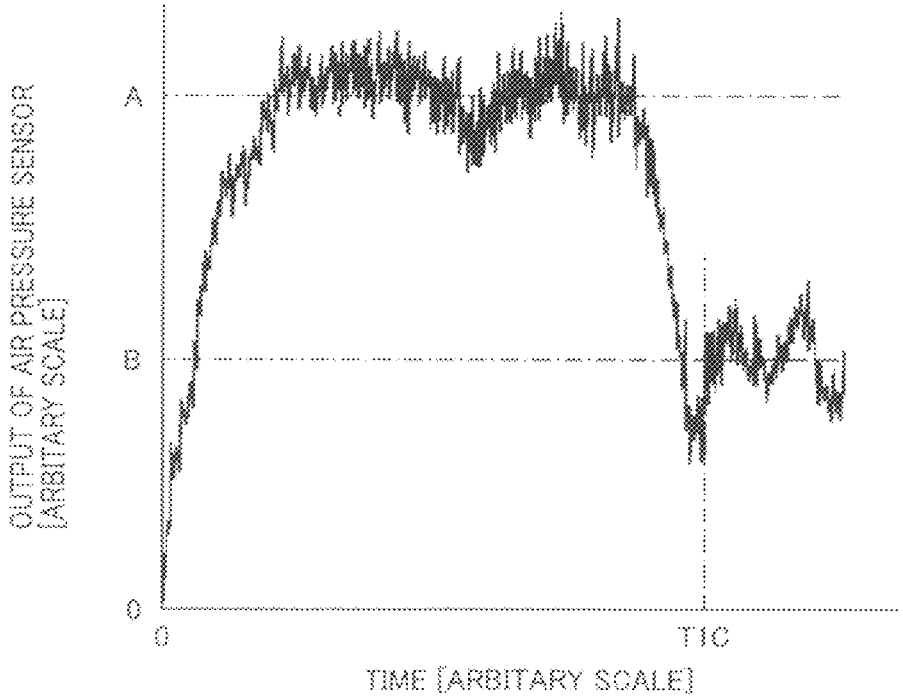
FIG. 11 shows a relation between a time interval from when the air pump is activated to when the conveyance of the developer is started and an output value of an air pressure sensor.

FIG. 11 is a relation between the time period from when the air pump 60 is started to when the conveyance of the developer is started and the output value of the air pressure sensor 11. In FIG. 11, the output value of the air pressure sensor 11 is increased immediately after the air pump 60 is activated, the output value is increased to and is kept at a large value A. Then, the output value is decreased to and is kept at a lower value B that is lower than the value A. In a state during which the output value is the value A, the developer is not transported in the developer transport tube 5 because the developer is clogged therein. In a state during which the output value is the value B, the clog has been dissolved and the developer is transported in the developer transport tube 5. That is, when the output value is at a time T1C changing from the value A to the value B, the developer is started transporting in the developer transport tube 5. Accordingly, the change in the value of the air pressure sensor 11 is monitored in the controller 200, and the controller 200 determines the time T1C at which the output value is changed (hereinafter just "state-changing time T1C").

In the present embodiment, when the development device 100 is first activated, the air pump 60 is activated for 2 second that is the transit time during which the developer passes the developer transport tube 5 from the upstream end to the downstream end has elapsed in addition to this determined state-changing time T1C, and then the air pump 60 is stopped, which completes the escape operation of the developer. However, when the output value of the air pressure sensor 11 is not increased to the value A but directly reaches the value B, for example, in a case in which the stop time of the development device 100 is short and the increase of the bulk density of the developer is small, the controller 200 determines that the time at which the output value reaches the value B is the state-changing time T1C. It is to be noted that, after this escape operation, the development-portion driving motor 10 that drives the development portion 2, the agitator driving motor 45 that drives the developer agitation container 40, and the rotary-feeder driving motor 55 that drives the rotary feeder 50 may be activated continuously, and then developer may be circulated, which is no problem.

In addition, similarly to the first embodiment, during the escape operation of the developer, the rotary-feeder driving motor 55 that drives the rotary feeder 50 is stop state, whether or not the development-portion driving motor 10 that drives the development portion 2 is operated is determined based on the capacity of the developer retainer (the developer dropping tube 6, the developer supply tube 7). In a case in which the development-portion drive motor 10 is operated, the air pump 60 is activated after 2 second that is the transit time during which the developer passes the developer transport tube 5 from the upstream end to the downstream end has elapsed in addition to the determined state-changing time T1C. In this case, the operation time of the air pump 60 is around 2 second that is identical to the transit time during which the developer passes the developer transport tube 5 from the upstream end to the downstream end.

Herein, in the present embodiment, the escape operation of the developer is executed based on the finish state data to be determined whether or not the stop condition of the development device 100 is normal, stored in the controller 200 in the image forming apparatus 1000. Alternatively, the control operation of the development device 100 may perform that the escape operation of the developer never fails to execute at a start time of the first activated operation in the development device 100. In this operation, the finish state data to be determined whether or not the stop condition of the development device is normal is not necessary.

In the above-described the first and second embodiments, the developer in the developer transport tube 5 escapes to the developer retainer when the development device 100 is stopped and when the development device 100 is first activated. However, the escape operation of the developer may be performed a time period during which the printing operation is not executed, as yet another timing, based on the job data stored in the image forming apparatus 100.

In this control operation, similarly to the second embodiment, it is preferable that the control operation be executed at a time interval of the escape operation that is determined based on the change of the output value of the air pressure sensor 11. However, in a case in which the escape operation is executed when not much time interval has elapsed from the stop of the development device 100, it is assumed that the increase of the bulk density of the developer in the developer transport tube 5 do not occur. The time interval of the escape operation can be set in advance in a range of from the transit time during which the developer passes through the developer transport tube from the upstream end to the downstream end, to the arrival delay time T1 at the maximum bulk density in the toner concentration of the usable developer (around 3.5 second from the result of FIG. 5), without determining the time interval of the escape operation based on the output value of the air pressure sensor 11. It is to be noted that an acceptable value of the time interval from the stop time of the development device 100 is different based on the configuration of the developer transport tube, which is determined by the experiment. In the present embodiment, the time interval is around 1 minute.

By executing the above-described control operation, the activation delay time can be fixed to the transit time during which the developer pass the developer transport tube 5 from the upstream end to the downstream end. Accordingly, it becomes possible to design the circulation time in the development portion 2 to be set over the fixed activation delay time, thus preventing the depletion of the developer in the development portion 2. Thus, since losing the barrier formed by the developer can be prevented, blowing the air used for the conveyance of the developer from the development portion 2 can be prevented, and the scattering toner can be alleviated. In addition, by delaying the activation start time of the development portion 2, decrease in the amount of the developer in the development portion 2 can be prevented, and therefore, the developer can form the barrier stably.

Furthermore, since the depletion of the developer in the development portion when the development device 100 is activated can be prevented stably, the barrier formed by the developer, that is, the medium (barrier) to prevent the developer from ejecting outside by blowing the air is always present, and as a result, the leakage of the air used for the conveyance can be prevented. In the experiment, the scattering of the toner in the above-described configuration in the present disclosure can be reduced to one-dozens of that in a configuration in which the control operation is not executed.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development portion, to develop a latent image formed on a latent image carrier with a developer, disposed close to the latent image carrier;

a developer agitation container to agitate the developer, provided separately from the development portion;

a transport system connecting the development portion and the developer agitation container, through which the developer is transported from the developer agitation container to the development portion by air; and a developer retainer to temporarily retain the developer, disposed downstream from the transport system, to which the developer remaining in the transport system escapes, wherein, after the developing operation, a control is carried out to move the developer remaining in the transport system to the developer retainer disposed downstream from the transport system.

2. The development device according to claim 1, wherein the transport system comprises a vertical tube through which the developer is transported upward by the air in a substantially vertical direction, and the developer remaining in the vertical tube is moved to the developer retainer disposed downstream from the transport system.

3. The development device according to claim 2, wherein the developer retainer is configured to prevent the developer from flowing back down the vertical tube of the transport system.

4. The development device according to claim 3, wherein the transport system further comprises a horizontal tube through which the developer is transported by the air in a substantially horizontal direction, and the horizontal tube is disposed downstream from the vertical tube so that the developer is prevented from flowing in reverse from the developer retainer to the vertical tube.

5. The development device according to claim 1, further comprising:

a developer feeder to feed the developer from the developer agitation container to the transport system;

a pneumatic device to generate air that moves the developer from the developer feeder to the development portion through the transport system;

a developer circulation member provided inside the developer portion, to circulate the developer in the development portion conveyed from the developer agitation container; and a collection system connecting the development portion and the developer agitation container, through which the developer after circulation in the development portion is transported to the developer agitation container, wherein, in a state in which the development device receives a command to stop, the developer feeder is stopped, the developer in the transport system escapes to the developer retainer, and then the pneumatic device is stopped.

6. The development device according to claim 5, further comprising:

a control panel to transmit commands to activate and stop components in the development device;

multiple sensors to check operation of the components in the development device; and a controller having an input side connected to the sensors and an output side connected to at least the developer feeder and the pneumatic device, wherein, when the command to stop the operation of the development device is transmitted from the control panel, the controller stops the pneumatic device after the controller stops the developer feeder and the developer in the transport system escapes to the developer retainer.

7. The development device according to claim 6, wherein the developer in the transport system escapes to the developer retainer when the development device is first activated.

8. The development device according to claim 1, further comprising:

a developer feeder to feed the developer from the developer agitation container to the transport system;

a pneumatic device to generate air that moves the developer from the developer feeder to the development portion through the transport system;

a developer circulation member provided inside the developer portion, to circulate the developer in the development portion conveyed from the developer agitation container; and a collection system connecting the development portion and the developer agitation container, through which the developer after circulation in the development portion is transported to the developer agitation container, wherein, in a state in which the development device receives a command to start operation, the developer feeder is activated, the developer in the transport system escapes to the developer retainer, and then the pneumatic device is activated.

9. The development device according to claim 4, further comprising:

a control panel to transmit commands to activate and stop components in the development device;

multiple sensors to check operation of the components in the development device; and a controller having an input side connected to the sensors and an output side connected to at least the developer feeder and the pneumatic device, wherein, when the command to start the operation of the development device is transmitted from the control panel while the development device is stopped, the controller activates the pneumatic device, after the controller activates the developer feeder and the developer in the transport system escapes to the developer retainer.

10. An image forming apparatus comprising:

a latent image carrier to carry a latent image; and a development device comprising:

a development portion, to develop a latent image formed on a latent image carrier with developer, disposed close to the latent image carrier;

a developer agitation container to agitate the developer, provided separately from the development portion;

a transport system connecting the development portion and the developer agitation container, through which the developer is transported from the developer agitation container to the development portion by air; and a developer retainer to temporarily retain the developer, disposed downstream from the transport system, to which the developer remaining in the transport system escapes, wherein, after the developing operation, a control is carried out to move the developer remaining in the transport system to the developer retainer disposed downstream from the transport system.

11. The image forming apparatus according to claim 10, further comprising:

a control panel to transmit commands to activate and stop components in the development device;

multiple sensors to check operation of the devices in the image forming apparatus; and a controller having an input side connected to the sensors and an output side, wherein the development device further comprises:

a developer feeder to feed the developer from the developer agitation container to the transport system, connected to the output side of the controller;

a pneumatic device to generate air to move the developer from the developer feeder to the development portion through the transport system, connected to the output side of the controller;

a developer circulation member provided inside the developer portion, to circulate the developer in the development portion conveyed from the developer agitation container; and a collection system connecting the development portion and the developer agitation container, through which the developer after circulation in the development portion is transported to the developer agitation container, wherein, when the command to stop operation of the development device is transmitted from the control panel, the controller stops the pneumatic device, after the controller stops the developer feeder and the developer in the transport system escapes to the developer retainer.

12. The image forming apparatus according to claim 11 wherein the developer in the transport system escapes to the developer retainer when the development device is first activated.

13. The image forming apparatus according to claim 11 wherein the developer in the transport system escapes to the developer retainer in a time interval during which no printing operation is being performed by the image forming apparatus, as determined by job data stored in the image forming apparatus.

14. The image forming apparatus according to claim 10, further comprising:

a control panel to send commands to activate and stop components in the development device;

multiple sensors to check operation of the devices in the image forming apparatus; and a controller having an input side connected to the sensors and an output side, wherein the development device further comprises:

a developer feeder to feed the developer from the developer agitation container to the transport system, connected to the output side of the controller;

a pneumatic device to generate air to move the developer from the developer feeder to the development portion, connected to the output side of the controller;

a developer circulation device provided inside the developer portion, to circulate the developer conveyed from the developer agitation container to the development portion; and a collection system connecting the development portion and the developer agitation container, through which the developer after circulation in the development portion is transported to the developer agitation container, wherein when the command to start operation of the development device is transmitted from the control panel, the controller activates the pneumatic device, after the controller activates the developer feeder and the developer in the transport system escapes to the developer retainer.

* * * * *